United States Patent [19]

Lake

[11] Patent Number: 4,872,608

[45] Date of Patent: Oct. 10, 1989

[54] 18 CELL EGG CARTON WITH ANGLED LATCH FLAP

[75] Inventor: Connie Lake, Tinley Park, Ill.

[73] Assignee: S. Eisenberg & Co., Division of Creative Industries, Inc., Bridgeview, Ill.

[21] Appl. No.: 178,653

[22] Filed: Apr. 7, 1988

[51] Int. Cl.[4] ..... B65D 85/32

[52] U.S. Cl. ..... 229/2.5 EC; 206/521.8

[58] Field of Search ..... 229/2.5 EC, 2.5 R; 206/521.1, 521.8; 220/4 B

[56] References Cited

U.S. PATENT DOCUMENTS

| | | | |
|---|---|---|---|
| 3,563,446 | 2/1971 | Lake | 229/2.5 EC |
| 3,648,916 | 3/1972 | Commisso | 229/2.5 EC |
| 3,688,971 | 9/1972 | Phillips et al. | 229/2.5 EC |
| 3,817,441 | 6/1974 | Jackson | 229/2.5 EC |
| 4,143,111 | 3/1979 | Irwin | 229/2.5 EC |
| 4,240,575 | 12/1980 | Tange | 229/2.5 EC |
| 4,298,156 | 11/1981 | Reifers et al. | 229/2.5 R |
| 4,382,536 | 5/1983 | Congleton | 229/2.5 EC |
| 4,582,248 | 4/1986 | Bixler et al. | 229/2.5 R |
| 4,609,141 | 9/1986 | Lake | 229/2.5 EC |
| 4,625,905 | 12/1986 | Mangla | 229/2.5 EC |
| 4,625,906 | 12/1986 | Mangla | 229/45 EC |
| 4,625,907 | 12/1986 | Mangla | 229/2.5 EC |

FOREIGN PATENT DOCUMENTS

| | | | |
|---|---|---|---|
| 2449952 | 11/1975 | Fed. Rep. of Germany | 229/2.5 EC |

*Primary Examiner*—Gary Elkins

*Attorney, Agent, or Firm*—Hill, Van Santen, Steadman & Simpson

[57] ABSTRACT

A wide three row 18 cell egg carton adapted to be stacked for use in standard 12 cell egg filling machinery has a tray section with three longitudinal rows of side-by-side egg cells, an upwardly and outwardly inclined stiff latch flap integrally hinged to the front top edge of the tray section, a dished cover section integrally hinged to the top rear edge of the tray section and a perpipheral wall on the cover bottoming on the top of the tray section adapted to receiver the latch flap there behind and having receptacles to receive the latches of the flap. Pairs of the cartons are molded in side-by-side relation on a standard width thermoforming machine from thermoplastic sheet material and sufficient molding area for the wider three roll 18 cell cartons and the flaps is provided by forming the flaps of the pairs in juxtaposed side-by-side relation inclined toward each other away from the sheet line as the trays and covers of the carton are formed. The inclination of the flaps away from the sheet line provides additional space to mold the flaps without widening the forming area.

16 Claims, 3 Drawing Sheets

18 CELL EGG CARTON WITH ANGLED LATCH FLAP

FIELD OF THE INVENTION:

This invention relates to one-piece molded egg cartons with cellular trays, integral hinged covers, and latching flaps formed from thermoplastic sheet material on standard machinery with molds positioning the flaps in outwardly and upwardly inclined free state relation relative to the trays thereby permitting wide three row cellular cartons to be filled in and used with the same equipment provided for standard 12 cell two row cartons. Specifically this invention deals with three row width 18 cell egg cartons with outwardly and upwardly inclined free state stiff latching flaps adapted to be depressed inwardly from their free state condition behind a cover and spring biased into latched engagement with the cover.

DESCRIPTION OF THE PRIOR ART

Heretofore conventional 12 cell egg cartons having two rows of side-by-side cells were thermoformed from styrofoam sheets on machinery having a width accommodating the molding of pairs of such cartons in side-by-side relation. Such two row 12 cell cartons were then nested in flat open condition and packed within standard width filling machinery. A demand for three row 18 cell egg cartons is growing in the market place and it has been found that the standard filling machinery cannot accommodate three row cartons with standard latching flaps. Therefore, in order to use the standard machinery for the wider three row cellular cartons, it has been necessary to eliminate the latching flaps and withdraw the latches into the cellular tray area thus losing the latch flap advantages of reinforcing the cover to eliminate inadvertent unlatching when the carton is loaded or squeezed.

It would therefore be an improvement in this art to provide wider three row cellular cartons with latching flaps capable of being manufactured and used with standard two row cellular carton equipment.

SUMMARY OF THE INVENTION

According to this invention, cellular egg cartons are provided with upwardly and outwardly inclined latching flaps accommodating manufacture of three row wide cartons on standard molding machinery and stacking of the three row cartons for use on standard filling machinery. Standard packaging equipment for filling cellular egg cartons has an egg carton holder that will not accept a carton larger than one foot square in the open position and heretofore the wider three row 18 cell egg cartons could not fit such machinery if they had the conventional laterally extended latch flap. The present invention deforms the latch flap from the sheet line in the standard thermoforming machinery in such a way as to narrow the width gap necessary to produce the conventional laterally extended latch flaps lying in the sheet line. The latch flaps of this invention can be as wide as needed without widening the thermomolding machinery and at the same time the flaps will have a desired inclination to accommodate formations of latch fingers and stacking of the cartons in the packaging machinery.

The cartons have integral hinged together cellular trays and dished covers with an inclined latch flap along the front edge of the tray having projected latch fingers for snapping into keeper ports in the front wall of the cover. The cell designs, divider walls, and cover posts, may take many different forms to cooperate when the rim of the cover is bottomed on the rim of the tray in the closed condition of the carton. It is preferred that shoulders underlie at least portions of the rims so that when the cartons are nested or stacked for the packaging machine operation, the shoulders of an overlying open carton will rest on or just inside the rim of an underlying carton thus spacing the rims and cells without wedging the cartons together.

It will thus be understood that a main advantage of this invention is to provide latch flap equipped wide three row 18 cell egg cartons that can be manufactured on standard forming machinery and used on the standard filling equipment.

A specific feature of the invention is the provision of latching flaps on the trays of cellular egg cartons which extend upwardly and outwardly from the front rim of the tray in their free state condition and are depressed behind the front wall of the cover to create an outward spring bias which will maintain the flap in latched condition with the cover.

A preferred mode embodiment of this invention is shown on the accompanying drawings, in which.

BRIEF DESCRIPTION OF THE PREFERRED EMBODIMENT SHOWN ON THE DRAWINGS

Figure 1:
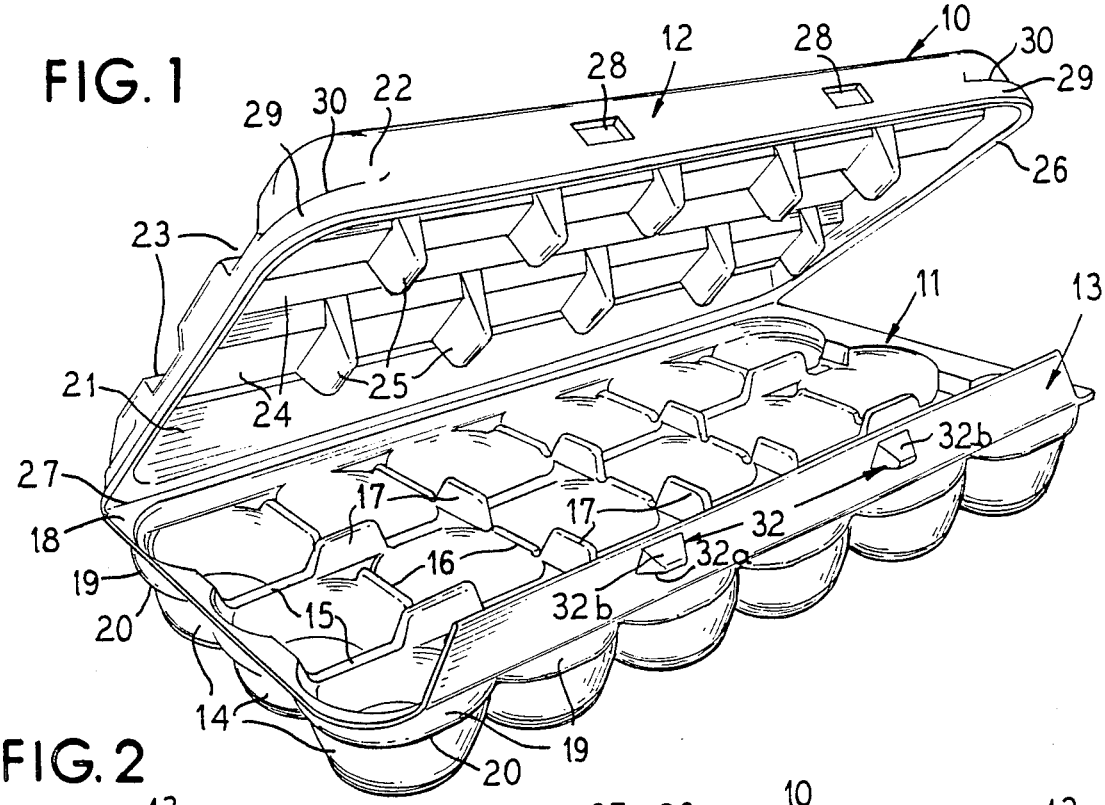
FIG. 1 is a perspective view of an open egg carton of this invention having a three row 18 cell tray, an integral cover hinged along the rear edge of the tray and an upwardly and outwardly included locking flap hinged along the front edge of the tray.

In FIG. 1 the reference 10 designates generally a three row 18 cell egg carton of this invention, preferably molded from a sheet of foamed plastic material such as polystyrene or any other suitable thermomoldable plastics material. The carton 10 has an integral tray 11, dished cover 12 and inclined latching or locking flap 13. The cover 12 and latching flap 13 are respectively hingedly attached to the rear and front edges of the tray 11.

The tray 11 has three rows of upright fragmentary ovate cells 14 with 6 cells in each longitudinal row thus accommodating 18 eggs. These cells 14 are separated by longitudinal dividing walls 15 and transverse dividing walls 16. Upstanding posts 17 project above these divider walls. A peripheral horizontal planar rim 18 surrounds the cells and divider walls. Embossments 19 around the outer peripheral portions of the cells 14 provide shoulders 20 underlying the peripheral rim 18.

Figure 3:
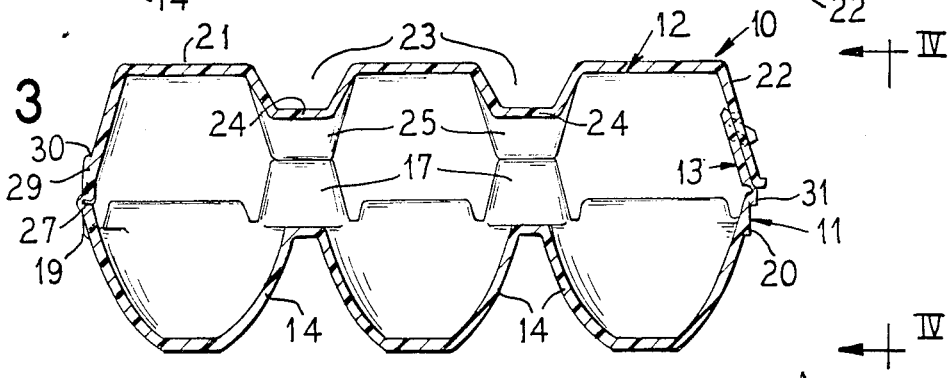
FIG. 3 is a transverse sectional view of the carton of FIG. 1 in closed position taken through the central portion of the side-by-side cells.

The cover 12 has a flat top 21 with a depending peripheral outwardly inclined sidewall 22. A pair of side-by-side longitudinal channels 23 in the top 21 provide sideby-side longitudinal stiffening ribs 24 in the cover from which project, at spaced intervals, posts 25 to engage the posts 17 projecting from the dividing walls 15 and 16 when the cover is closed as shown in FIG. 3.

The bottom edge 26 of the peripheral sidewall 22 of the cover is preferably outturned at least along the ends of the wall to provide a rim for seating on and mating with the flange or rim 18 of the tray 11 when the cover is closed.

An integral hinge section 27 integrally connects the back upper end of the tray with the back bottom edge of the peripheral wall 22 of the cover to swingable but integrally connect the cover and tray.

The front side of the peripheral wall 22 of the cover has a pair of latching ports or keepers 28 cut therethrough in longitudinally spaced apart relation inwardly from the ends of the cup, preferably about 1/3 of the length of the front wall.

Figure 2:
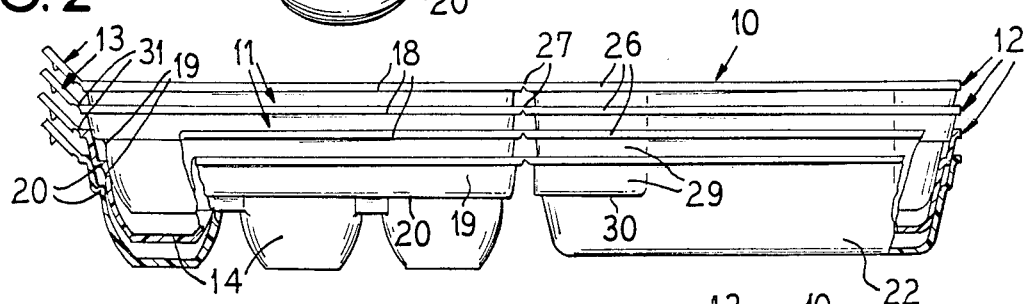
FIG. 2 is an end elevational view of a stack of nestled egg cartons of FIG. 1.

The corner portions of the peripheral wall 22 are embossed outwardly as indicated at 29 to form shoulders 30 which will bottom on or adjacent the flanges or bottom edges 26 of an underlying carton when the cartons are stacked in open conditions as shown in FIG. 2.

The latch flap 13 is hinge-connected along its entire length to the front edge of the tray flange 18 by a stiff but bendable thinned-down hinge line 31. The latch flap 13, in its free state condition, tilts upwardly and outwardly from the flange or rim 18 of the tray 13 and while it can be pressed inwardly from this outward inclined free state condition a few degrees beyond the vertical, the hinge line 31 is quite stiff to spring bias the flange back to its free state condition. The degree of inclination of the free state positions of the latch flap 13 is such as to provide an obtuse angle with the flat flange or rim 18 of the tray 11. Obtuse angles 120 to 140 degrees are useful to maintain a desired spring bias. The swinging range of the tray from its free state position to its latched position behind the cover is then much less than 90° to preserve the stiffness of the hinge line 31.

As shown in FIG. 2, when the cartons 10 are nested or stacked for a packaging operation, the shoulders 20 of the tray sections 11 and the shoulders 30 of the cover sections 12 will prevent the cells 14 from wedging together and will keep the outwardly inclined flaps 13 in spaced relation.

Figure 4:
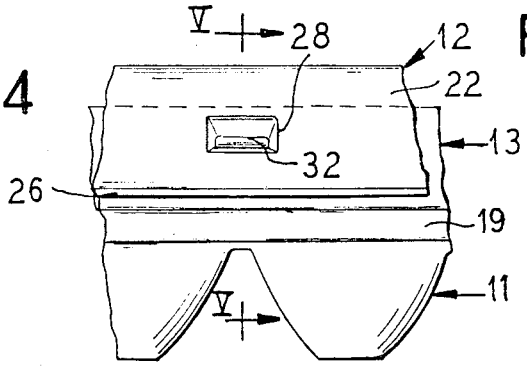
FIG. 4 is a fragmentary front elevational view along the line IV—IV of FIG. 3.
Figure 5:
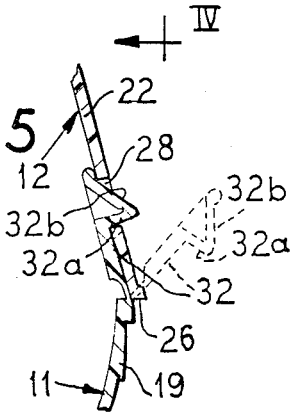
FIG. 5 is a fragmentary sectional view taken along the line VV—VV of FIG. 4.

As shown in FIGS. 3–5, the flaps 13 can be quite wide but should not be wider than the peripheral wall 22 of the cover 12 to fit freely behind this wall.

The latch flap 13, as shown in FIG. 1, has a pair of outward projections 32 pressed therefrom and aligned with the holes or ports 28 of the front of the peripheral cover wall 22 for seating therein. These projections 32, as shown in FIG. 5, have a radial bottom edge 32a and an inwardly inclined top edge 32b so that when the latch flap 13 is pushed under the front peripheral wall of the cover, the bottom or rim edge 26 of the cover will slide over the inclined wall 32b until it reaches the opening 28 whereupon the spring bias of the flap will snap the projection through the opening with its radial edge 32a engaging the bottom ledge of the opening to retain the cover in closed position.

Figure 6:
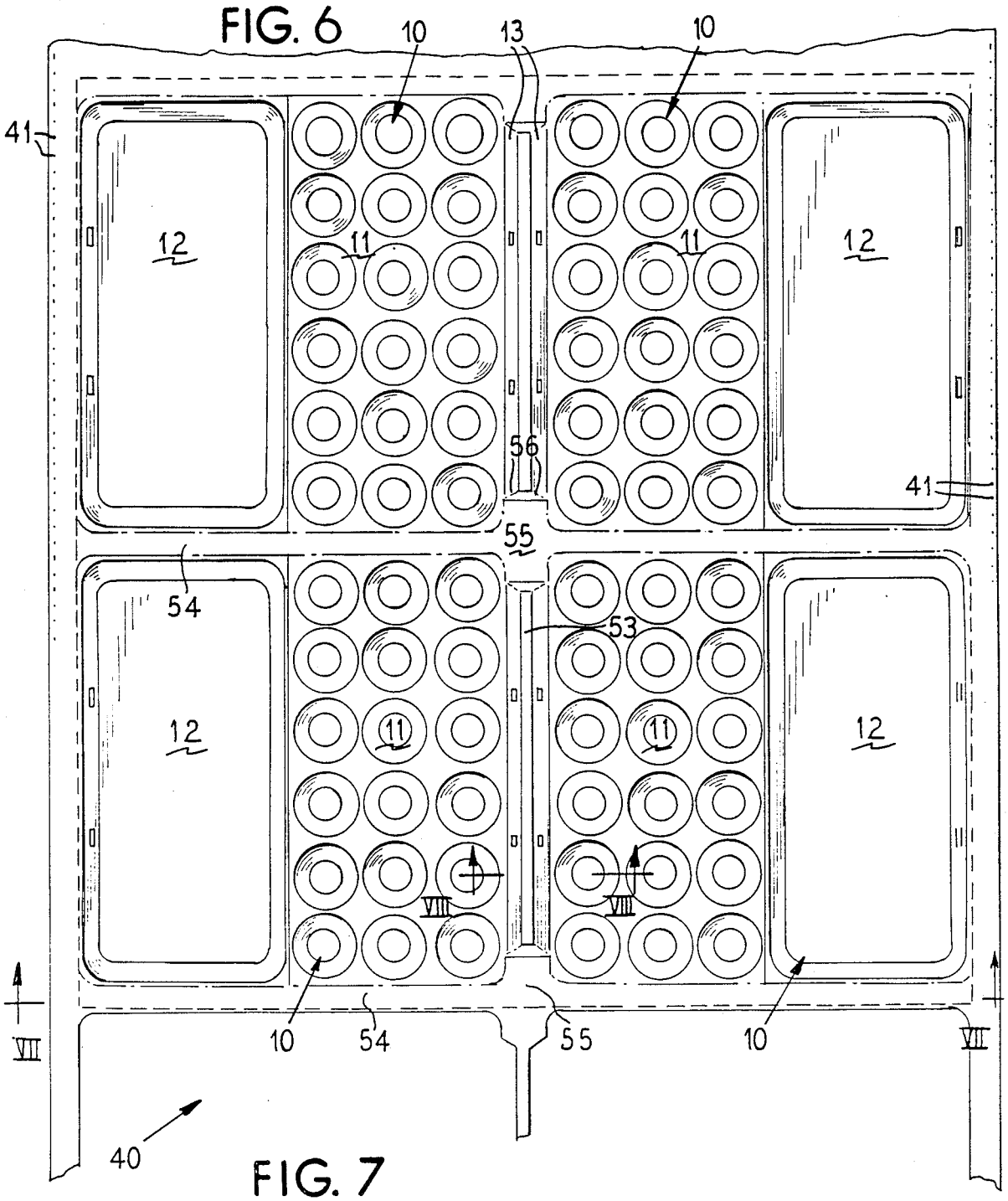
FIG. 6 is a fragmentary top plan view of a foamed styrofoam sheet pinned on conveyers of a carton molding machine showing the manner in which the cartons of this invention are made in side-by-side and tandem relation.
Figure 7:
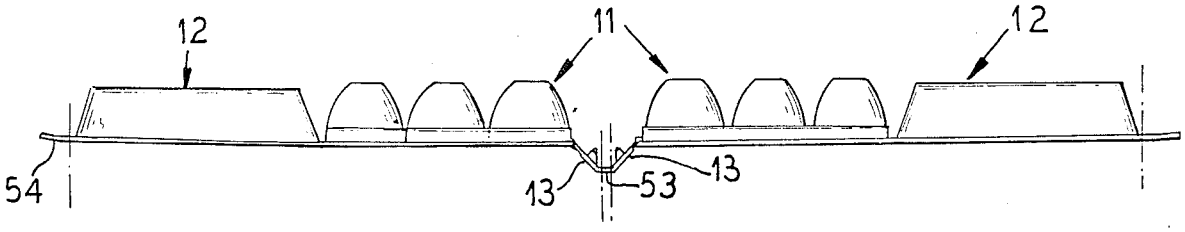
FIG. 7 is an end elevation view of the molded sheet along the line VII—VII of FIG. 6.
Figure 8:
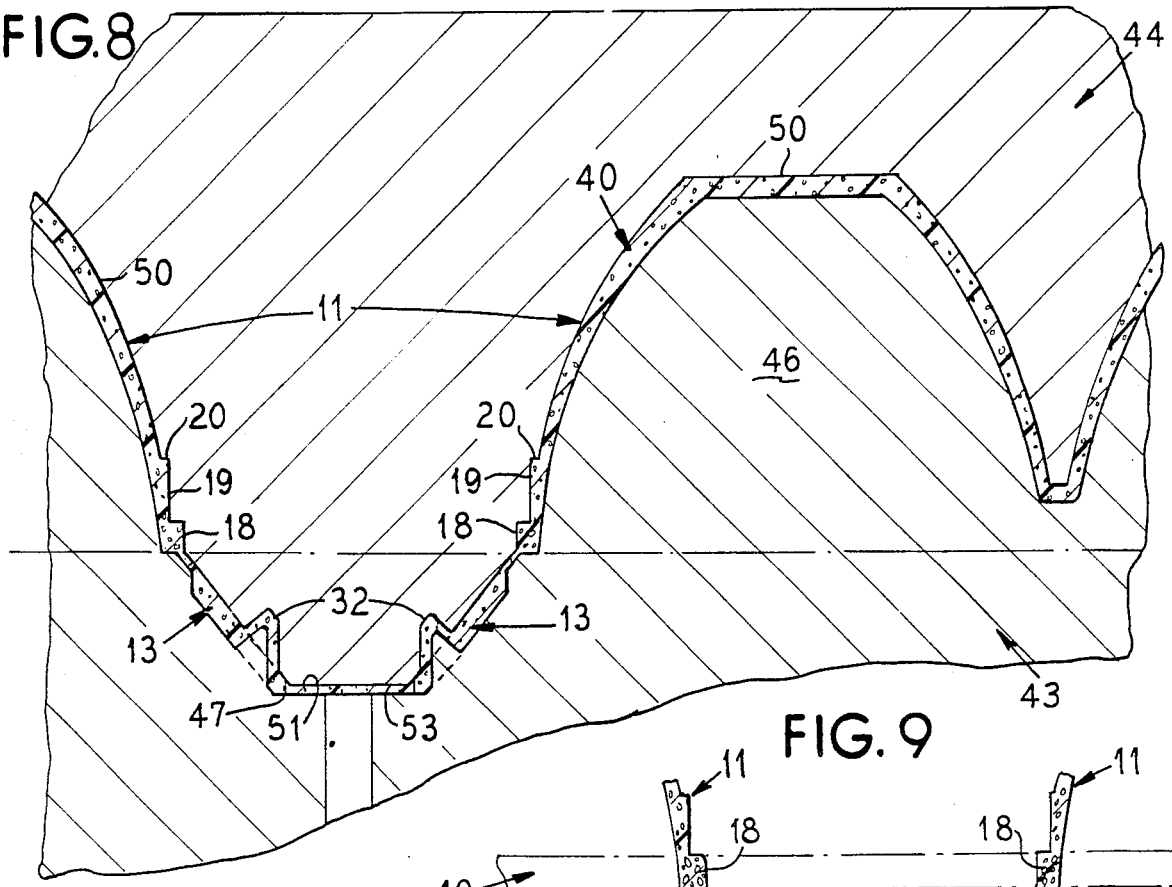
FIG. 8 is a fragmentary enlarged vertical sectional view of the flap portions of the molded sheet of FIGS. 6 and 7 taken along the line XIII—XIII of FIG. 6 and showing the forming dies of the machine in closed position.
Figure 10:
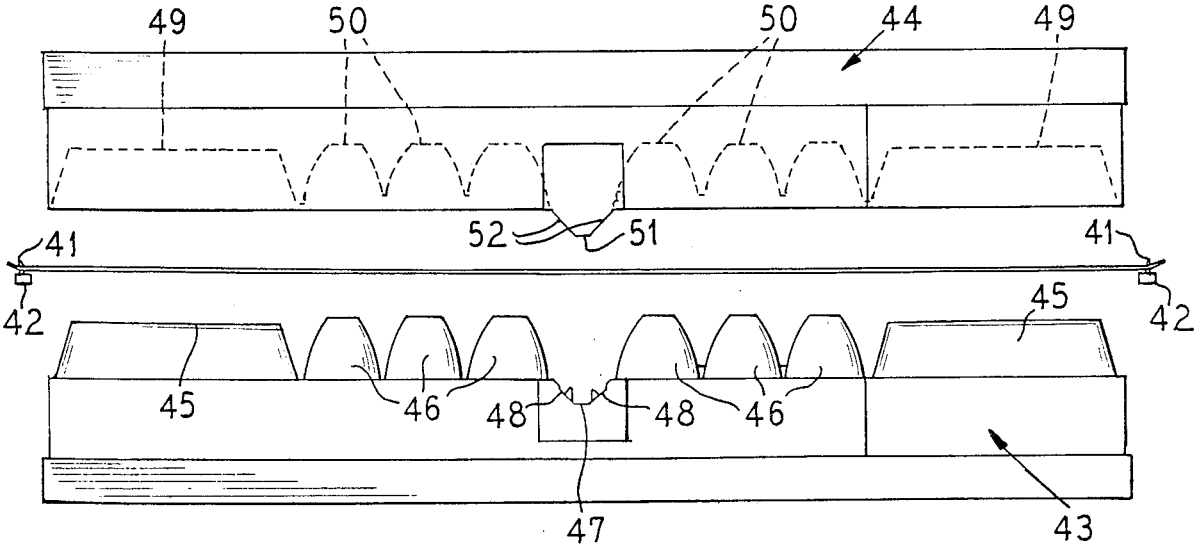
FIG. 10 is a somewhat diagrammatic transverse elevational view illustrating the manner in which the dies of the molding machine approach the sheet line of the pin held styrofoam sheet to form a pair of cartons in side-byside relation.

As shown in FIGS. 6 and 7, four cartons 10 of this invention may be simultaneously thermomolded from a flat sheet 40 of foamed thermoplatic material carried on pins 41 of conveyor chains 42 (FIG. 10) between a bottom male mold 43 and a top female mold 44 (FIGS. 8 and 10). These molds are arranged in tandem and in side-by-side pairs so as to form the four cartons in one closing. For this multi-molding procedure, the outboard longitudinal sides of the molds form the cover portions 12 of the four cartons, the mold sections just inboard from these cover forming sections form the tray portions 11 of the cartons and the longitudinal central portion of the molds form the locking flap sections 13 of the cartons.

As shown in FIG. 10, the male mold 43 has the tray forming projections 45, the cell forming projections 46 and a central trough recess with a flat narrow bottom 47 from which diverge sloping flap forming sides 48.

The top female mold 44 on the other hand has mating recesses 49 for projections 44, cellular recesses 50 for the projections 46 and a central nose protuberance with a flat leading edge 51 to mate with the flat bottom edge 47 of the die 43 and inclined sides 52 to mate with the inclined sidewalls 48 of the die 43.

Figure 9:
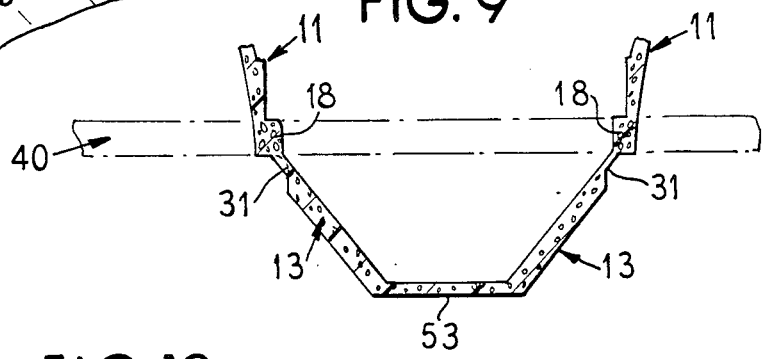
FIG. 9 is a transverse sectional view of the flap portions showing how the foamed styrofoam is stretched and compressed to stiffen the flaps and hinge.

As illustrated in FIG. 9, when the dies 43 and 44 are brought together, the thermoplastic sheet 40 therebetween is molded to form the adjacent tray portions 11 of the side-by-side cartons, the adjacent latch flaps 13 with the projections 32 and the ends of these latch flaps are connected by a bridging strip 53 that is severed from the flaps.

As illustrated in FIG. 6, the molded cartons are stamped free from surrounding sheet material 40 and the transverse strips 54 connecting the tandem pairs of stamped cartons. These strips are cut with widened central portions 55 so that the ends of the flaps 13 will terminate inwardly from the ends of the cartons. The length of the flaps 13 is therefore less than the length of the cartons so that the flaps will clear the ends of the peripheral wall 22 of the cover when the flaps are locked under the cover. The end edges of these flaps are preferably inclined inwardly as illustrated at 56.

As shown in FIG. 9, the central longitudinal strip portion of the sheet 40 from which the flaps 13 are formed is stretched and thinned down as the strip is deformed from the sheet line. This compresses the foam making the flaps stiffer and more rigid. In this same stretching and squeezing operation the dies pinch the hinge lines 31 connecting the flaps to the tray flanges 18 to further compress the foam and form very stiff hinges that resist bending. This provides a strong spring effect urging the flaps to their outwardly included free state positions. Thus in their locked positions the flaps provide back up supports for the front wall 22 of the cover 12 and prevent accidental unlatching.

From the above descriptions it will therefore be understood that this invention provides latch flap equipped wide 18 cell egg cartons that can be manufactured on and used with standard equipment for the narrower 12 cell cartons.

I claim as my invention:

1. A molded one-piece cellular carton adapted to be manufactured in an opened position from thermoplastic sheet material and used on standard packaging machinery which comprises an open top tray with a planar peripheral rim providing front, back and end walls and having a plurality of open top individual cells within the confines of said rim, a dished cover for closing said tray integrally hinged to the tray rim along the backwall thereof, said cover having peripheral sidewalls bottoming on the rim of the tray in the closed position of the carton, said front planar rim wall of the tray having an upwardly and outwardly inclined latching flap along the length thereof terminating inwardly from the rim end walls and joined to the tray through an integral hinge line accommodating inward swinging of the flap against spring bias from its free state outwardly inclined position to an inwardly inclined position behind the front peripheral wall of the cover, the free state outwardly inclined position of the latching flap defining an obtuse angle with the tray rim of about 120 to 140 degrees.

2. The carton of claim 1 wherein the latching flap is stretched to an increased width and the hinge line is squeezed to a decreased thickness to increase the rigidity of the flap and the stiffness of the hinge line.

3. The carton of claim 1 wherein the tray has three longitudinal rows of individual cells in side-by-side relation.

4. The carton of claim 1 wherein the latching protuberances on the flap are die-pressed fingers with inclined top faces and radial bottom faces.

5. The carton of claim 1 having a substantially one foot width in its opened position.

6. The carton of claim 1 including said cells having corner peripheries and embossments projecting from corner peripheries of the cells and cover providing shoulders to stack the open cartons in spaced relation to each other.

7. A latch flap equipped wide three row 18 cell molded one-piece egg carton adapted to be used on standard two row 12 cell carton packaging machines which comprises an open top tray with a peripheral rim having front, back and end portions, three longitudinal rows of 6 egg receiving cells depending from and surrounded by said rim, a dished cover having a flat top with a peripheral depending wall having back, front and end portions, an integral hinge line connecting the back portion of the tray rim to the back portion of the peripheral wall of the cover adapted to swing the cover over the tray with its peripheral wall bottomed on the rim of the tray, a latching flap inclined upwardly and outwardly along the length of the front portion of the tray rim, a stiff rigid hinge line integrally connecting the latching flap to the front portion of the tray rim accommodating inward swinging of the flap behind the front portion of the peripheral wall of the cover, said latching flap having latching fingers projecting therefrom at spaced intervals along its length, and said front portion of the peripheral wall of the cover having recesses receiving said fingers to lock the cover in closed position over the tray, said latching flap having an as molded free state with the flap extending outwardly and upwardly from the tray with the free state outwardly inclined position of the latching flap defining an obtuse angle with the tray rim of about 120 to 140 degrees.

8. The carton of claim 7 formed from foamed polystyrene sheet material wherein the flap is stretched and thinned down from the sheet thickness and the hinge line connecting the flap to the tray is squeezed to a thinner cross-section than the flap.

9. The carton of claim 7 including outwardly embossed carton portions on the tray and cover providing shoulders to stack open trays in spaced nested relation.

10. The carton of claim 7 wherein the latching flap has a width less than the width of the depending peripheral wall of the cover to fit freely behind said wall.

11. The carton of claim 7 wherein the latching flap terminates inwardly from end portions of the rim of the tray.

12. The carton of claim 7 wherein the front portion of the peripheral wall of the cover slopes outwardly and the latching flap is pushed inwardly as the cover slides thereover.

13. The carton of claim 7 wherein the spring bias on the latching flap holds the flap against the front portion of the peripheral wall of the cover to reinforce the wall.

14. In a molded egg carton having a cellular tray with front and rear sides and an as molded tray rim, a dished cover hinged on the rear side of the tray, and a latching flap hinged on the front side of the tray adapted to be swung behind the dished cover to lock the cover to the tray, the improvement of said latching flap being integrally molded to said tray in an outwardly and upwardly inclined free state position defining an obtuse angle of between 120 degrees and 140 degrees with the tray rim and the flap attached to the front wall through a compressed hinge line maintaining a stiff spring bias urging the flap to its said position.

15. The further improvement of claim 14 wherein the latching flap is stretched to a thinner cross section than the front side of the tray.

16. The further improvement of claim 14 including die pressed latch fingers on the flap.

* * * * *